US006645070B2

(12) United States Patent
Lupo

(10) Patent No.: US 6,645,070 B2
(45) Date of Patent: Nov. 11, 2003

(54) 3D ROTATING VIEWPOINT GAME

(76) Inventor: Kenneth G. Lupo, 15333 J.F.K. Blvd. - Suite 160, Houston, TX (US) 77032

( * ) Notice: Subject to any disclaimer, the term of this patent is extended or adjusted under 35 U.S.C. 154(b) by 0 days.

(21) Appl. No.: 10/391,436

(22) Filed: Mar. 17, 2003

(65) Prior Publication Data

US 2003/0148803 A1 Aug. 7, 2003

Related U.S. Application Data

(63) Continuation of application No. 10/115,795, filed on Apr. 3, 2002, and a continuation of application No. 09/414,283, filed on Oct. 7, 1999, now abandoned.

(51) Int. Cl.[7] ..... A63P 9/24; G06F 17/00

(52) U.S. Cl. ..... 463/9; 273/271

(58) Field of Search ..... 463/9, 10, 14, 463/15, 32, 33; 273/241, 260, 261, 275, 283, 271

(56) References Cited

U.S. PATENT DOCUMENTS 3,879,040 A * 4/1975 Smith ..... 273/241

6,062,978 A * 5/2000 Martino et al. ..... 463/9

* cited by examiner

*Primary Examiner*—Michael O'Neil
*Assistant Examiner*—Julie Brocketti
(74) *Attorney, Agent, or Firm*—The Matthews Firm

(57) ABSTRACT

Some popular games suitable for stimulating imagination and exercising logic and deductive skills, such as Tic-Tac-Toe, rapidly lose their utility with respect to stimulating imagination or exercising logic or deductive skills due to the static nature of their play and the limited numbers of moves available. Three dimensional games such as a three-dimensional Tic-Tac-Toe game having greater than nine total substructures is more challenging for game players, although one drawback is the inability of the players to easily visualize, and thereby comprehend, the choices a three dimensional playing surface provides. The present invention provides a three dimensional game with an expanded number of moves available as well as a rotatable playing structure where each substructure within the playing structure has mutatable characteristics when viewed prospectively, allowing players to more easily visualize, and thereby comprehend, the choices three dimensional playing surfaces provide.

30 Claims, 5 Drawing Sheets

3D ROTATING VIEWPOINT GAME

RELATED APPLICATIONS

This application is a Continuation of U.S. Ser. No. 09/414,283; filed Oct. 7, 1999 now abandoned and a Continuation of U.S. Ser. No. 10/115,795 filed Apr. 3, 2002.

TECHNICAL FIELD

The present invention relates to games, specifically a three dimensional game of logic and strategy.

BACKGROUND ART

Games have long stimulated imagination and exercised logic and deductive skills. However, some popular games, including those suitable for children such as Tic-Tac-Toe, rapidly lose their utility with respect to stimulating imagination or exercising logic or deductive skills due to the static nature of their play and the limited numbers of moves available. Other games, such as chess, have long been challenges because they present numerable, albeit finite, numbers of possible moves and strategies.

Over the last several decades, game players have departed from two dimensional games such as chess and Tic-Tac-Toe in favor of playing games with three dimensional playing perspectives whose rules reflect the addition of the third playing dimension, such as three dimensional checkers or three dimensional chess. One drawback to these games is the inability of players to easily visualize, and thereby comprehend, the choices three dimensional playing surfaces provide, irrespective of the implementation of the game, i.e. in a physical medium or via computer simulation.

A further problem with migrating two dimensional games to three dimensional play is that the simplicity of two dimensional game rules does not easily translate to three dimensional play.

It is therefore an objective of the present invention to provide a three dimensional game to stimulate imagination and exercise logic and deductive skills which has an expanded number of moves available, leading to a less static set of game rules and game play.

It is a further objective of the present invention to allow players to more easily visualize, and thereby comprehend, the choices three dimensional playing surfaces provide.

It is a further objective of the present invention to have an embodiment of the three dimensional game implemented in a perspective view on a computer display.

It is a further objective to provide a three dimensional game whose rules reflect three dimensional play.

Accordingly, a three dimensional game is described.

BRIEF DESCRIPTION OF DRAWINGS

For a further understanding of the nature and objects of the present invention, reference should be had to the following detailed description, taken in conjunction with the accompanying drawings, in which like elements are given the same or analogous reference numbers and wherein.

GENERAL DESCRIPTION AND PREFERRED MODE FOR CARRYING OUT THE INVENTION

The present invention describes an entertainment and strategy game apparatus and method. In the preferred mode, the apparatus is implemented on a general purpose programmable computer as a three dimensional game variant of Tic-Tac-Toe.

Figure 1:
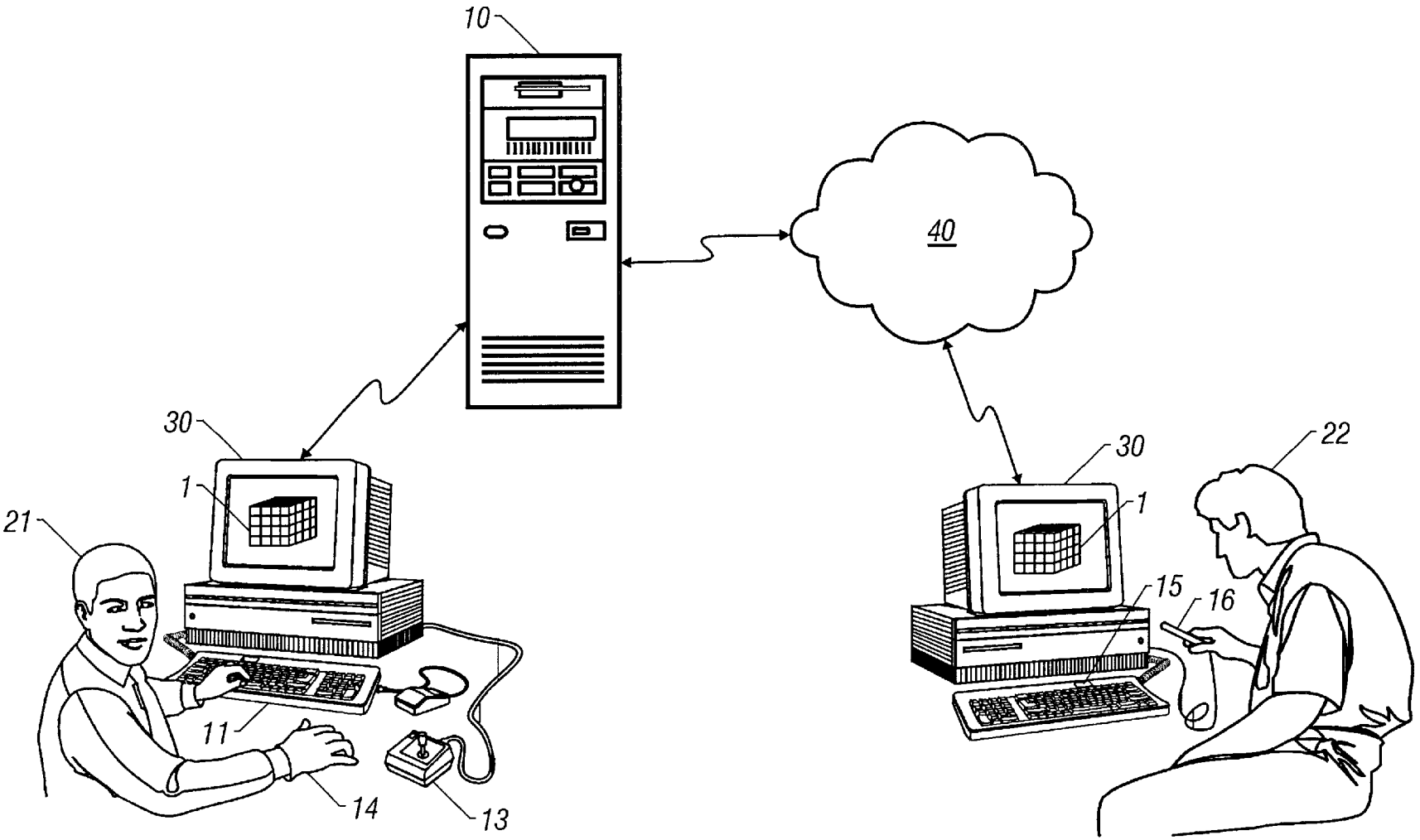
FIG. 1 is a schematic view of a game playing embodiment.

Referring now to FIG. 1, a schematic view of a game playing embodiment, in a preferred embodiment game players 21 and 22, jointly referred to herein as game player 20, interact with game play software (not shown in FIG. 1 but described generally in FIG. 4 through FIG. 8) executing under the control of game controller 10 to manipulate playing structure 1. Game controller 10 may be a general personal computer such as a computer using a Pentium® processor manufactured and marketed by Intel® Corp., a specialized computer such as a Sony® PlayStation® or Nintendo®, a specialized handheld game play controller such as the Nintend® GameBoy®, or any other programmable controller. In an alternative embodiment, playing structure 1 may be an independent structure not requiring any game controller 10 or game software.

In the preferred game controller embodiment, a first game player 21 interacts with the game play software via input devices such as keyboard 11, mouse 12, joystick 13, game glove 14, touchpad 15, light pen 16, other devices capable of communicating with game controller 10, or any combination thereof. In multiuser game play, a second game player 22 also interacts with game play software via input devices such as keyboard 11, mouse 12, joystick 13, game glove 14, touchpad 15, light pen 16, other devices capable of communicating with game controller 10, or any combination thereof. In alternative embodiments, any means of interacting with game controller 10 may be used including, as examples but not as limitations, trackballs (not shown), optical devices (not shown), voice controllers (not shown), or the like. In a further alternative embodiment, game controller 10 and display 30 may be an independent device such as a handheld or otherwise manipulatable physical structure. In an alternative non-game controller embodiment, game players 20 may interact with playing structure 20 using tokens (not shown), injectors (not shown), grips (not shown), needles (not shown), slides or doors (not shown), or any other device capable of selecting any substructure 2 (not shown in FIG. 1).

In the preferred game controller 10 embodiment, game player 21 and game player 22 may be collocated at the same physical game controller 10, for example using the same game controller 10, display device 30, and input device. Alternatively, game player 20 can use a plurality of display devices 30 and input devices connected to a single game controller 10 as through a local communications controller such as an asynchronous terminal multiplexer. In further alternative embodiment, either or both of game player 21 and game player 22 interact with game controller 10 through data communications pathway 40 such as the Internet; a local area network; a wide area network including by way of example and not limitation cellular networks such as CDPD or other data wide area networks; dial-up connections such as to bulletin board systems as that term is understood by those skilled in the computer arts; or by a combination of the above.

In the preferred embodiment, playing structure 1 is a cube displayed on display 30 which can be a computer display monitor, an LCD display device, or a three dimensional device such as a holographic projection device (not shown) or separate physical cube (not shown). Playing structure 1 may be any shape capable of subdivision into a plurality of substructures 2, e.g. a sphere. In the preferred embodiment, substructures 2 are cubes of equal size. In an embodiment where game controller 10 and display device 30 are an independent device (not shown in the figures) such as described herein above, playing structure 1 may incorporate display 30 into the independent device. In an alternative embodiment that does not require game controller 10, display 30 is playing structure 1.

It is further anticipated that all or some number of game players 20 may be physically collocated or dispersed, such as game players 20 connected to or in communication with game controller 10 via communications pathways 40 such as multi-terminal computer systems or the Internet.

Figure 2:
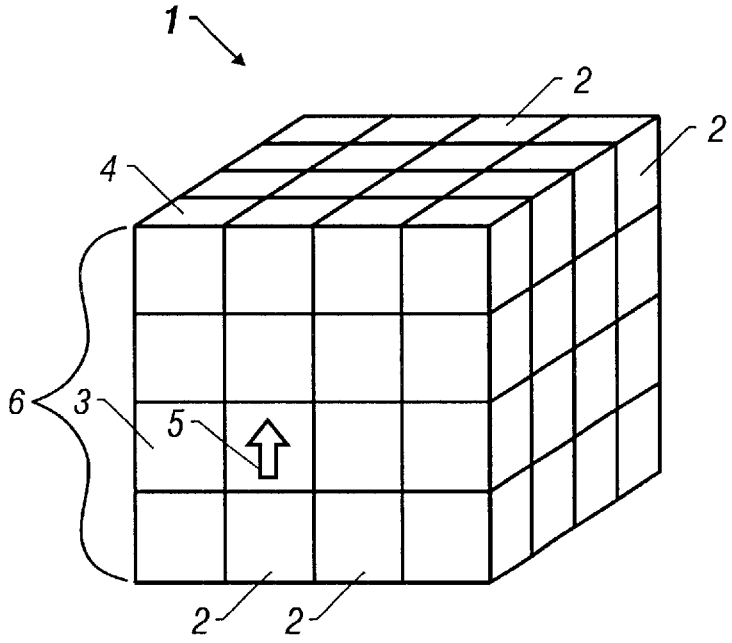
FIG. 2 is a perspective view of the present invention's playing structure in the preferred embodiment.

Referring now to FIG. 2, a perspective view of the present invention's playing structure 1 in the preferred embodiment, one goal of the present invention's game may be for game players 20 (not shown in the figure) to capture all substructures 2 in a row 3, column 4, or diagonal (not shown in the figure), similar to Tic-Tac-Toe. As playing structure 1 may be freely rotated in a three dimensional perspective by game player 20, row 3 could be presented at any instant as column 4 of playing structure 1. As used herein, "row" and "column" with respect to playing structure 1 are therefore synonymous.

As further used herein, game player 20 can be a human or can be under programmatic control, i.e. a separate component of the game play software which can act as if it were a human game player 20, formulating strategy and selecting moves, the numerous means by which this is done being readily understood by those skilled in the art.

In its preferred embodiment, playing structure 1 is implemented by game play software executing within game controller 10, and is presented as a displayable computer image on display 30, for example on a monitor or LCD panel or other display device as all these are understood by those skilled in the computer arts. However, playing structure 1 may be embodied in an alternative medium such as a hand-held playing structure 1 made of plastic, glass, other translucent material, or any combination thereof.

In its preferred embodiment, playing structure 1 is comprised of a number of substructures 2 where an equal number of substructures 2 are present on each side 6 of and throughout playing structure 1. As can be appreciate by those skilled in the art, playing structure 1 can be spherical with side 6 understood to mean one of a set of opposing surfaces or arcs. Playing structure 1 may default to a pre-determined number of substructures per row 3, such as four substructures 2 which would make each side 6 of playing structure 1 have a total of sixteen substructures 2 with a total of sixty-four substructures 2 contained within playing structure 1. Any number N of substructures 2 is permitted as long as playing structure 1 has an equal number of rows and columns. The lower the value for N, the less complex the game play. In the preferred embodiment, the minimum value for N is three.

Each substructure 2 has at least one mutable characteristic to indicate selection status. In the preferred embodiment, the mutable characteristic is color. Further, each game player 20 has a mutatable characteristic assigned to that game player 20, either manually selected by game player 20, programmatically assigned by the game play software, or a combination thereof. The assignment of mutatable characteristics such as color may be selected by each game player 20 alternatively by an optional menu (not shown in FIG. 2). A means to access and select each substructure 2 is provided to each game player 20 where the access and selection means enables game player's 20 ownership of that substructure 2. In a preferred embodiment for a computer implementation, cursor 5 is positioned by game player 20 to the desired substructure 2 by the access and selecting means, e.g. mouse 12 or joystick 13 (not shown in FIG. 2). Alternatively, the mutatable characteristic can be shape, texture, patterns, or any other visual or tactile indicator or combination thereof. Game players 20 access and select substructures 2 using any appropriate input devices such as keyboards 11, mice 12, joysticks 13, touch pads 15, light pens 16, or other pointing and selecting devices. In a further alternative embodiment, where playing structure 1 is a physical structure such as a hand-held cube, the mutable characteristic may be accomplished by use of insertable members such tokens, insertable into substructure 2; manipulatable structures such as doors or slides imbedded within substructure 2; imbedded physical devices such as light emitting diodes or other light sources; or physical media such as injectable fluids. By way of example and not limitation, playing structure 1 could be filled with a liquid, and players could inject a die having a color representing that player into substructure 2, changing the color of the liquid inside substructure 2. After play is completed, playing structure 1 could be emptied of the liquid and refilled for future play.

Once selected by game player 20, substructure 2 will indicate a change from non-owned status to owned status via one or more of its mutatable characteristics, e.g. change color to that color unique to the game player 20 making the selection.

As an option in an embodiment of the present invention, one or more game players 20 can be implemented programmatically, allowing a single game player 20 to play against game controller 10. The present invention's game play software can be optionally tailored to adhere to predetermined game playing rules and criteria including sophistication of play, user interface, and the like. By way of example and not limitation, game player 20 can select from a set of "personalities" such that programmatically generated play would be accompanied by feedback or comments from the game play software exhibiting the "personality" selected, e.g. a rude personality, a sinister personality, a friendly personality, and so on. The game play software generated game player 20 can accordingly be a tutor for younger or less experienced game players 20 or exhibit other responses to make game play more enjoyable for human game players 20.

Figure 3:
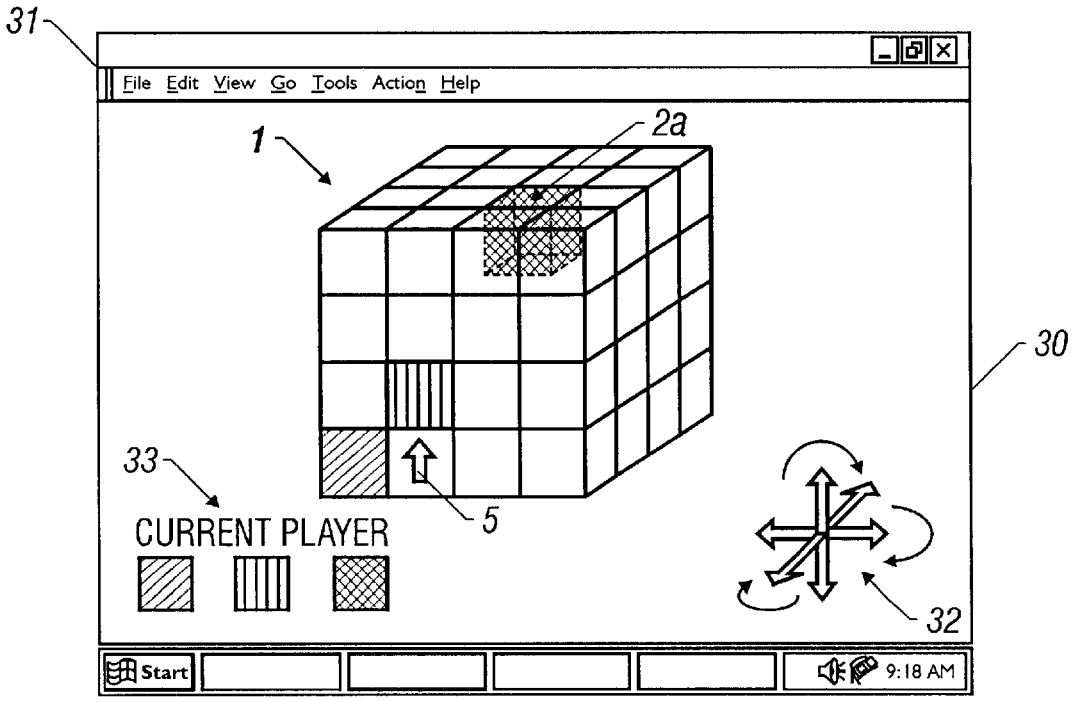
FIG. 3 is a generalized view of an exemplary screen display of a computer implemented embodiment of the present invention.

Referring now to FIG. 3, a generalized view of an exemplary screen display, display device 30 may have menu 31 from which game player 20 may select one or more program options such as initiating game play, configuration, and the like. By way of example and not limitation, graphical rotation control 32 may be presented to game player 20 for rotation of playing structure 1. In an alternative embodiment, cursor 5 positioned on or near playing structure 1 may be used to rotate playing structure 1. One or more informational areas 33 may also be displayed to indicate pertinent information to game player 20. By way of example and not limitation, informational areas 33 could include current game player 20, current score, mutatable characteristic for each and/or current game player 20, suggested moves, possible moves, rounds remaining as in a round limited game, time remaining as in a time-limited game, or any combination thereof. Additionally, options may be presented on menu 31 to allow game player 20 to have that game player's 20 or any other game player's 20 substructures outlined or otherwise highlighted within playing structure 1.

As opposed to the prior art, as playing structure 1 rotates along its X-Y-Z axes or zooms in or out perspectively the game play software renders playing structure 1 such that a first substructure 2 is rendered to merge characteristics of that substructure 2 with those characteristics of the other substructures 2 which are viewable perspectively by game players 20 and at least partially obscured by the first substructure 2, such as subcube 2*a* in FIG. 3. By way of example and not limitation, if the mutatable characteristic is color, rotation of playing structure 1 will cause a substructure 2 which is the closest in perspective to game player 20 to have its color shaded and altered by the color of the one or more substructures 20 within playing structure 1 perspectively behind that closest substructure 2, e.g. a blue substructure 2 will appear purple if perspectively in front of a red substructure 2. In the preferred embodiment, rendering of substructures 2 occurs continuously from the perception of game players 20. In an alternative embodiment, rendering of substructures 2 occurs at discrete time intervals, e.g. once per second. In a further alternative embodiment, rendering of substructures 2 occurs when an event occurs, e.g. rotation of playing structure 1 stops. If one or more game players 20 is located physically distant from display 30, e.g as would be the case in Internet multi-user play, the game play software may update all displays 30 upon movement of playing structure 1. Updates may be configured to occur in discrete time periods, e.g. once per second; upon some event such as lack of movement over some period of time, e.g. no movement for ten seconds; an affirmative event such as a mouse click or keyboard key press; programmatically, e.g. upon selection of a substructure 2; or any combination thereof.

Figure 4:
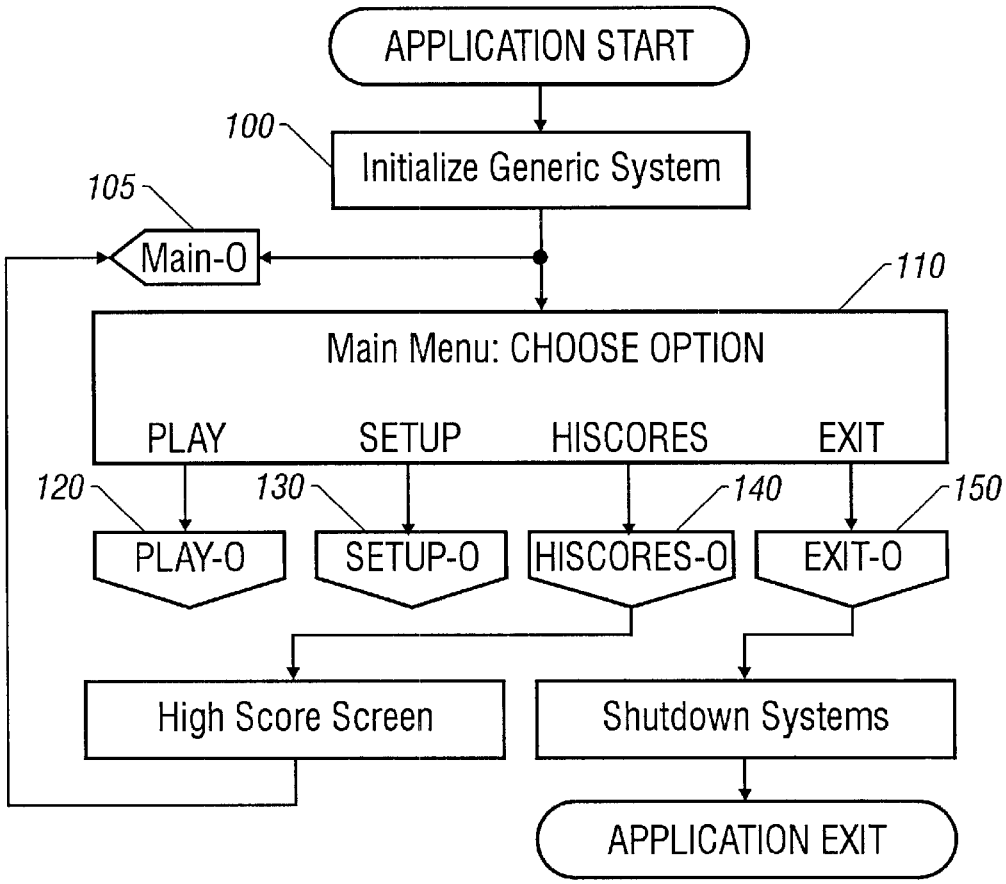
FIG. 4 is a flow diagram of the initial programmatic steps of a computer implemented embodiment of the present invention.

In the operation of the present invention, referring now to FIG. 4, a flow diagram of the initial programmatic steps of a computer implemented embodiment of the present invention, at step 100 playing structure 1 is initialized into a structure comprising N times N times N substructures 2. In the preferred embodiment, playing structure 1 is a cube and N is four, meaning playing structure 1 has sixty-four subcubes 2. Additionally, game controller 10 is initialized with appropriate device drivers for sound, display attributes, input devices, communication means, and so forth. A splash screen as that term is understood by those skilled in the computer arts may be presented to the users while step 100 initializes game controller 10.

As playing structure 1 is initialized, one game player 20 must be designated the first game player 20. If game player 20 is playing against game controller 10, the human game player 20 may go first. Otherwise, numerous methods of selecting a first game player 20 may be implemented and selected optionally by game players 20. By way of example and not by way of limitation, these methods may include having game players 20 enter their names via keyboard 11 or other appropriate input device and manually selecting a first game player 20; game players 20 entering their names via keyboard 11 or other appropriate input device where the first game player 20 to so enter a name is the first game player 20 by default; use of random number generators to arbitrarily select one of game players 20; presenting a selection representation image (not shown in the figures) to game players 20 on display device 30 such as dice or wheels or slot machine windows or the like to allow each game player 20 in turn to obtain a game play sequencing slot, e.g. roll the "dice"; presenting a selection representation image to game players 20 such as playing cards or straws or the like to allow each game player 20 in turn to obtain a game play sequencing slot, e.g. high card goes first; allowing each game player 20 to input a number within a range of numbers, generating a random number within that same range, and designating the game player 20 closest to the random number as the first in game play sequence; or any other suitable means. For more than two game players 20, the above game play sequencing methods may be repeated until all game players 20 are placed into a game playing sequence.

After initialization, a main menu (not shown in the figure) is presented at step 110. Main menu items (not shown in the figure) may be selected by one or more game players 20 through means with which a programmer skilled in computer arts will be familiar, including but not limited to a keystroke, e.g. a function key; a combination of keystrokes, e.g. the "alt" key in combination with another key; cursor control, e.g. moving cursor 5 to a menu item for selection of that item; voice control; or any other suitable method or combination thereof. As indicated in FIG. 4, among the menu items may be selections allowing game play 120, setup 130, and exiting the game 150. Optional menu items such as a list of previously earned high scores 140 may also be presented.

Figure 5:
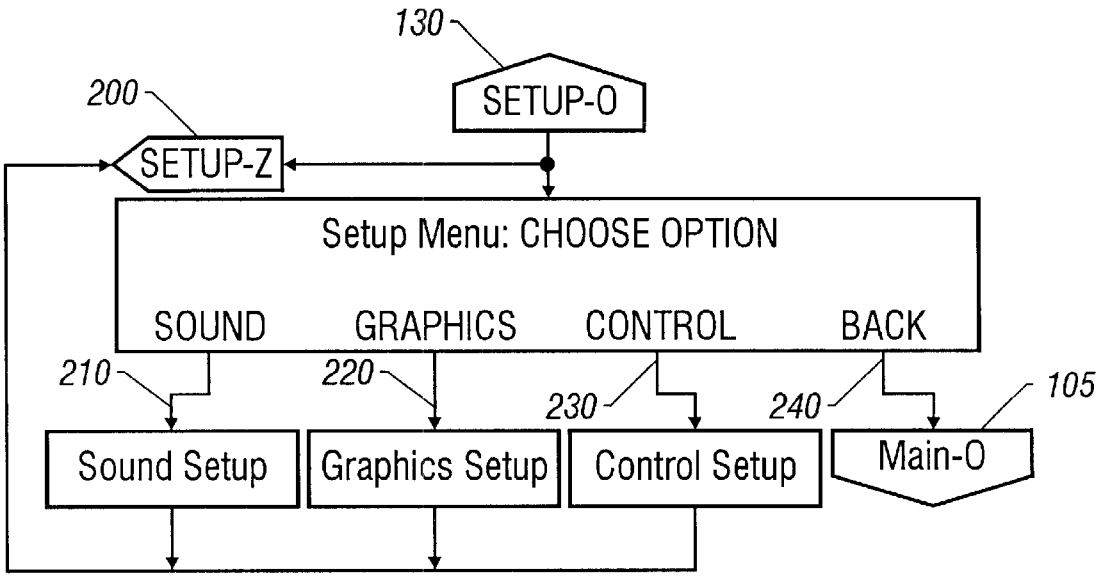
FIG. 5 is a flow chart showing game setup of a computer implemented embodiment of the present invention.

Referring now to FIG. 5, a flowchart showing game setup, game player 20 who selects game setup 130 may be allowed to configure or otherwise tailor one or more game play attributes such as sound 210, graphics 220, controls 230, or any combination thereof. Sound 210 may be selected by game player 20 to interface with the game play software to control or configure sound items such as volume level; background music; sound effects and the like, including by way of example and not limitation association of one or more sounds with one or more triggering events such as a selection of substructure 2; illegal moves; round limits; time limits; game play options such as time-limited play or point-oriented play; completion of rows or columns; start of the game; end of the game; draws; commenting by the game play software in a mode of game play where the game play software provides audio clues; characteristics such as personality or language associated with the computer's language audio portion; and combinations thereof.

Figure 6:
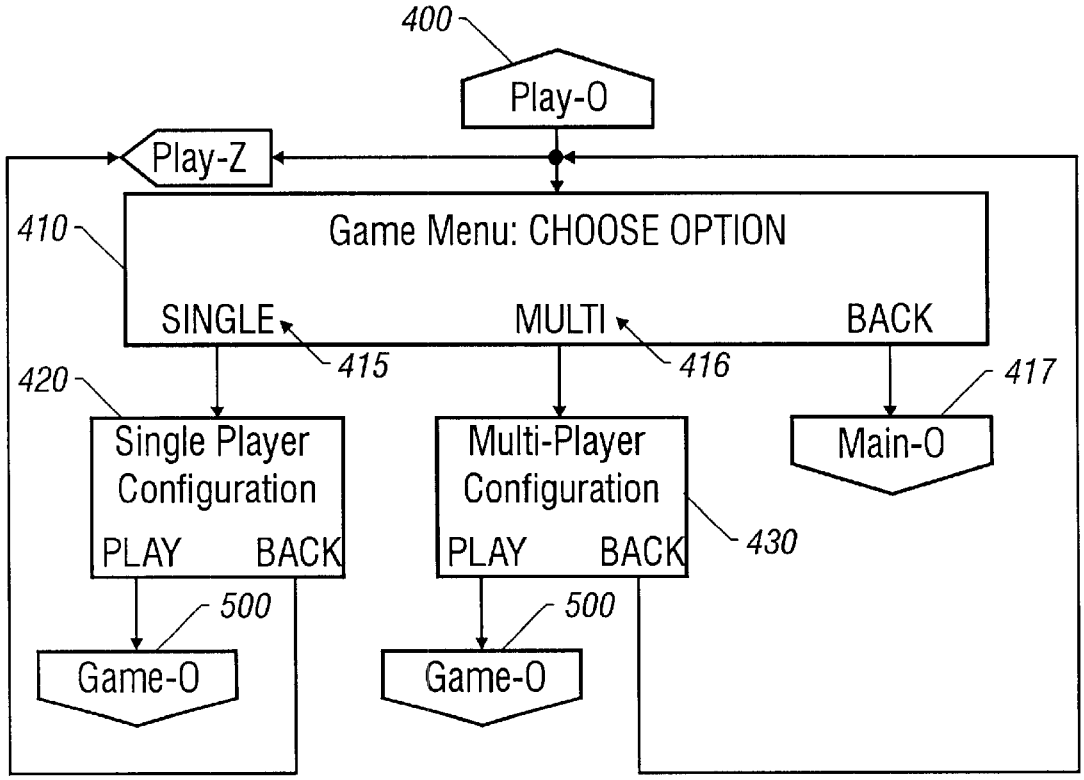
FIG. 6 is a flow chart describing a general game play menu of a computer implemented embodiment of the present invention.

Referring now to FIG. 6, a flow chart describing a general game play menu 400, once the order of game playing has been determined, a first game player 20 initiates actual game play.

In single player mode, at step 420 game player 20 plays against game controller 10. The single game player 20 may select a menu option (not shown in the figures) to select the number of substructures 2 to be present in playing structure 1. In an alternative embodiment, play may begin using a predetermined number of number of substructures 2 to be present in playing structure 1, e.g. as determined by a game player 20 at step 130 in FIG. 4. In a further embodiment, game play may begin by having the game play software present a choice to game player 20 as to the number of substructures 2 to be played, e.g. a fill-in-the-blank dialog, a drop-down list with choices, or the like, all of which are readily known and understood by those skilled in the computer arts. The number of substructures 2 may default to a number of substructures 2 specified by game player 20 at step 130 in FIG. 4.

Additionally, and in a like manner to the steps for selecting the number of substructures 2 detailed herein above, game play options may be tailored and configured by game player 20, including by way of example and not limitation the level of the game play software competence, mode of game play such as time-limited playing mode or point-oriented mode or non-limited playing mode, time limitations, and the like. The level of game play software competence may include items such as the number of moves to look ahead by the game play software and other constraints, all of which are readily known and understood by those skilled in the computer arts.

In a multi-player configuration, as indicated at step 430, in an embodiment of the present invention each game player 20 may select one of two modes of play, with only one host permitted. The host game player 20 selects the number of substructures 2 as indicated herein above at step 430. The host game player 20 then may inform the game play software of the number of guest game players 20 to be active during that game play session, e.g. host game player 20 uses a fill-in-the-blank dialog, a drop-down list with choices, or the like, all of which are readily known by and understood by those skilled in the computer arts. In one alternative embodiment, each guest game player 20, in turn, may then identify himself or herself to the game play software. In another alternative embodiment, game play may begin upon the host game player 20 informing the game play software of the number of total guest game players 20.

Figure 7:
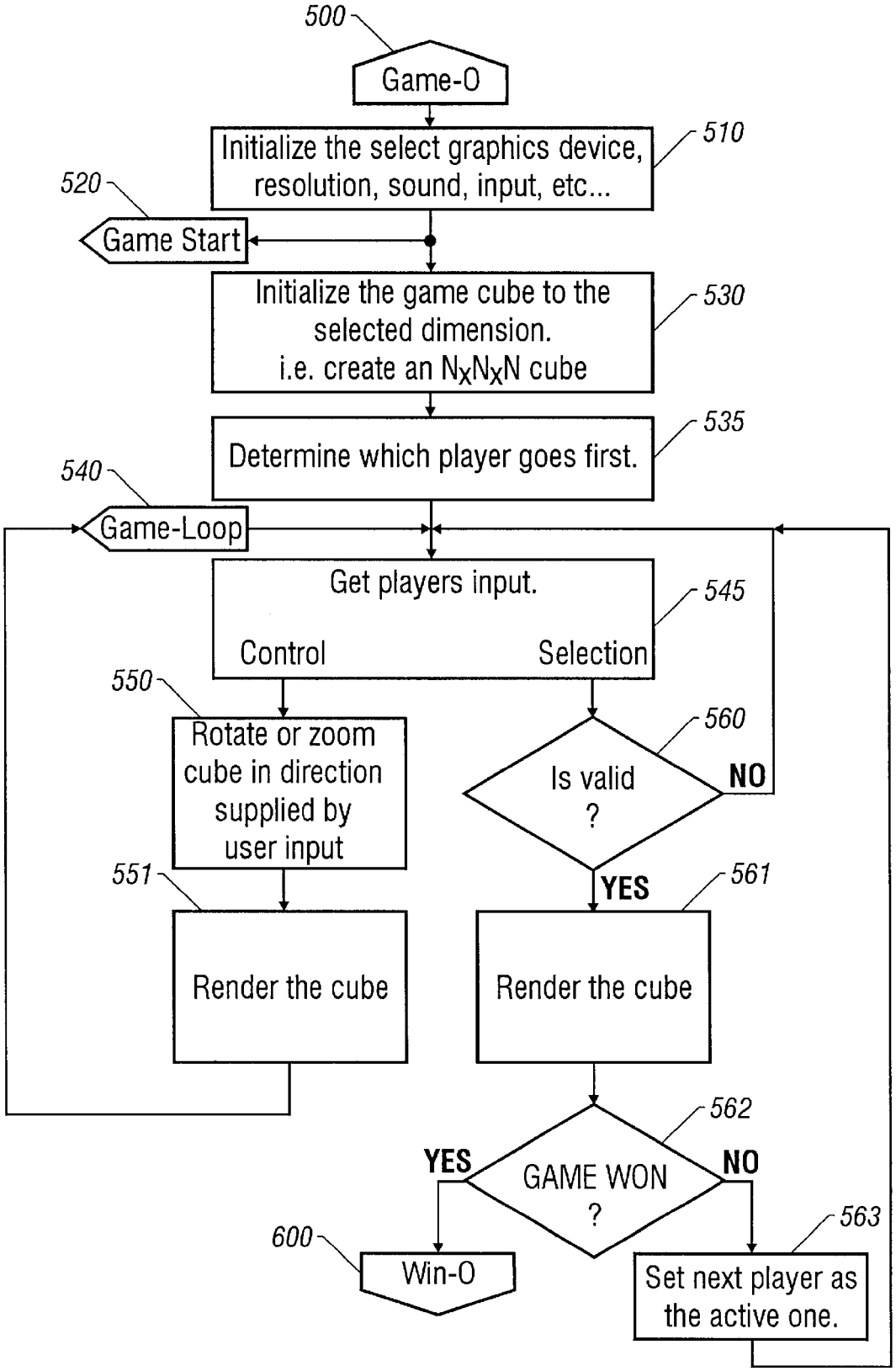
FIG. 7 is a flow diagram of the rotational and selection programmatic steps of a computer implemented embodiment of the present invention.

Referring now to FIG. 7, a flow diagram of the rotational and selection programmatic steps of the invention, once the order of game players 20 has been determined and other items needing configuration and/or initialization have occurred, game players 20 have two major options from which to choose at step 545: game control 550 or selection 560 of a particular substructure 2. Additionally, game controls may include asking the game play software for help, receiving hints on one or more possible next plays from the game software, or any combination thereof, at any time during game play.

At step 550, the game player 20 whose turn of game play is then currently active may rotate playing structure 1 and/or zoom playing structure 1 in or out perspectively by indicating to the game play software the direction of playing structure 1 rotation or amount of zoom desired using numerous methods, all of which are readily known by and understood by those skilled in the computer arts. In one alternative embodiment, rotation may be controlled by joystick 13 such that movement of joystick 13 moves playing structure 1 in its X-Y-Z coordinate planes, the method of which is readily known by and understood by those skilled in the computer arts. In an alternative embodiment, movements of mice 12 can be used to move playing structure 1 in its X-Y-Z coordinates, e.g. movement of the cursor 5 on display 30 to indicate the rotation desired. In a further alternative embodiment, interactive game play peripherals such as game gloves 14 can be used where hand movements with and/or within game glove 14 indicate the desired movement of playing structure 1 in its X-Y-Z coordinate planes. Perspective zoom of playing structure 1 may be accomplished in like manner.

During game play, game players 20 must select substructures 2 in order to win the game. In the preferred embodiment, a single substructure 2 is selected at step 545 per turn for each game player 20. Game player 20 selects one substructure 2 from the N by N by N possible substructures 2 where the desired substructure 2 is not already selected by another game player 20. Actual selection may occur by using cursor 5 or other screen pointer such as a cross-hair (not shown in the figures) to indicate which substructure 2 game player 20 desires to select and then requiring an affirmative act such as clicking or releasing a button on mouse 12, entering a key via keyboard 11, using a button on joystick 13, light pen 16, touch pad 15, any combination thereof, or any other method as such as those well known to those skilled in the computer arts. Selection can also be by programmatic determination, such as in the case of game controller 10 itself being the game player 20 making the selection. For example, as will be understood by those skilled in the computer arts, game player 20 may select an icon (not shown in the figure) representing that game player 20 and drag the icon over to a desired substructure 2, dropping the icon into the desired substructure 2 to complete selection of substructure 2.

At step 560, the game play software determines whether the selection is valid, e.g. the desired and selected substructure 2 is not currently owned by another game player 20. If the selected substructure 2 is available, the mutatable characteristic of the selected substructure 2 may be altered into its owned state to reflect ownership by that game player 20 who made the selection. In one embodiment, a second affirmative act may be required before completion of the selection is allowed, e.g. game player 20 must further answer a question or complete some task.

In alternative embodiments, a plurality of substructures 2 may be selected per game player 20 turn by the selection means described herein above.

After selection of substructure 2 at step 560, the game play software determines 562 if the selection has completed one row 3, column 4, or diagonal for the then current game player 20. If it has, game play continues at step 600. If not, game play focus shifts to the next game player 20 in turn, and resumes at step 540. As with two dimensional games, step 562 may further decide that no further play is possible, i.e. all substructures 2 are selected. In this case, the game is at a draw and the game software concludes at step 600.

Figure 8:
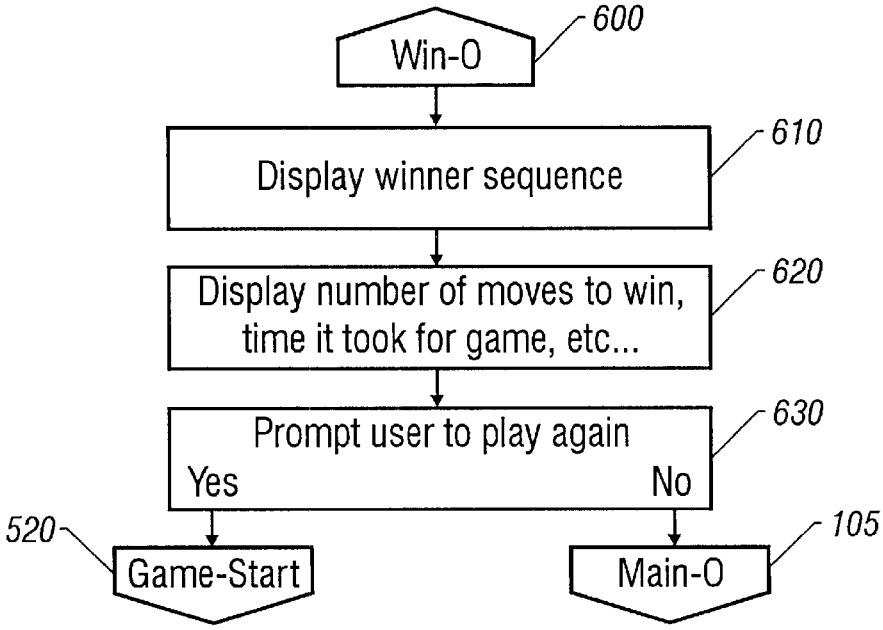
FIG. 8 is a flow diagram of the completion programmatic steps of a computer implemented embodiment of the present invention.

Referring now to FIG. 8, a flow diagram of the completion programmatic steps of the invention, at step 610 the game software may optionally and configurably exhibit game conclusion behavior. This may include visual, aural, or tactical sequences, or any combination thereof. By way of example and not limitation, playing structure 1 may be seen to explode, flash colors, change shapes, collapse, disintegrate, have alternative images superimposed, or any combination thereof. Additionally, the game software may play music, play songs, produce speeches including congratulatory speeches, emit noises, or any combination thereof. Further, tactile responses may be produced such as to game glove 14 or, in the embodiment where playing structure 1 is a handheld device, shakes, rattles, movements, or any combination thereof.

Configurably, the game software may also present information to game players 20 at step 620 such as the number of moves taken, length of time played, numbers of substructures selected, or any combination thereof.

At step 630, the game software may conclude execution of the game or prompt game players 20 to determine if game players 20 wish to conclude or play again. If game players wish to play again, play resumes at step 520. If play is not to resume, the game software may continue executing at step 105 or exit altogether.

It may be seen from the preceding description that a three dimensional game of logic and strategy is provided.

It is noted that the embodiment of the computer implemented game of logic and strategy described herein in detail for exemplary purposes is of course subject to many different variations in structure, design, application and methodology. Because many varying and different embodiments may be made within the scope of the inventive concept(s) herein taught, and because many modifications may be made in the embodiment herein detailed in accordance with the descriptive requirements of the law, it is to be understood that the details herein are to be interpreted as illustrative and not in a limiting sense.

What is claimed is:

1. A game apparatus comprising a playing structure capable of being viewed in a three dimensional perspective, the playing structure having N times N times N independently selectable substructures for a predetermined integer N, each substructure further having at least one viewable mutable characteristic which changes upon selection of the substructure, wherein said mutatable characteristic is substantially transparent, and wherein a first substructure indicates its mutatable characteristic as modified by each mutatable characteristic of each other substructure at least partially obscured by the first substructure when viewed in perspective wherein a first substructure indicates the unique mutatable characteristic of the game player whom selected it as modified by each unique mutatable characteristics of the same game player or any other game player who selected any of the other substructure that at least partially obscure said first substructure when viewed in such a perspective; and wherein the playing structure is freely rotatable about any of three axes, each of the axes extending at least partially through the playing structure with all three axes intersecting at a predetermined point within the playing structure.

2. The game apparatus of claim 1 wherein the substructures are arranged into an equal number of rows and columns, each row having N substructures and each column having N substructures.

3. The game apparatus of claim 1 wherein N is at least 3.

4. The game apparatus of claim 1 wherein the playing structure is freely rotatable about any of three axes, each of the axes extending at least partially through the playing structure with all three axes intersecting at a predetermined point within the playing structure.

5. The game apparatus of claim 1 wherein the mutatable characteristics are selected from the group of characteristics consisting of color, shape, texture, patterns, and contents.

6. The game apparatus of claim 1 wherein the playing structure is a parallelogram.

7. The game apparatus of claim 1 wherein the substructures are parallelograms.

8. The game apparatus of claim 1 further comprising:

at least one game play controller;

at least one input device appropriate for selecting each of the substructures, the input device being operatively in communication with the game play controller;

game play software executing within the game play controller, the game play software capable of changing the at least one viewable mutatable characteristic of a selected substructure upon selection of that substructure; and at least one display device for displaying the playing structure as a three dimensional playing structure, the display device operatively in communication with the game play controller, whereby each of the substructures is rendered on the display device according to that substructure's at least one viewable mutatable characteristic as modified by each at least one viewable mutatable characteristic of each other substructure at least partially obscured by that substructure when viewed in perspective.

9. The game apparatus of claim 8 wherein the input device is selected from input devices consisting of keyboards, mice, joysticks, game gloves, touchpads, and light pens.

10. The game apparatus of claim 8 wherein:

the at least one display device is a plurality of display devices operatively in communication with the game play controller; and the at least one input device is a plurality of input devices operatively in communication with the game play controller.

11. The game apparatus of claim 10 further comprising a data communications pathway selected from the group of data communications pathways consisting of local communications controllers, local area networks, wide area networks, packet switched networks, and dial-up networks; wherein the data display devices are operatively connected to the game play controller through the data communications pathway.

12. A method of game playing for a game apparatus comprising a playing structure viewable in three dimensional perspective, the playing structure comprising a plurality of substructures arranged into rows, columns, and diagonals, each substructure having a status of selected or non-selected, each substructure further having at least one other viewable mutatable characteristic, the method comprising the steps of:

initializing all the mutatable characteristics of all the substructures to a predetermined state;

initializing all substructures to have a status of non-selected;

selecting a first game player from a set of at least one game players;

assigning selectively each other game player a sequential position for game play;

assigning a unique one of the mutatable characteristics to each game player wherein said mutatable characteristics are substantially transparent; and allowing selection of at least one substructure by each game player sequentially beginning with the first game player until game play is completed, the sequential selection comprising the steps of:

accepting game player input to select a non-selectable substructure;

changing a status of the substructure from non-selected to selected;

changing a mutatable characteristic of the selected substructure to the unique mutatable characteristic of the game player;

wherein a first substructure indicates the unique mutatable characteristic of the game player whom selected it as modified by each unique mutatable characteristics of the same game player or any other game player who selected any of the other substructure that at least partially obscure said first substructure when viewed in such a perspective;

ending game play if selecting a non-selected substructure completes a row, column, or diagonal for the game player by each substructure in the row, column, or diagonal having that game player's mutatable characteristic;

ending the game if the game player selects the last non-selected substructure; and continuing the game if selecting a non-selected substructure does not complete the row, column, or diagonal for the game player and other non-selected substructures exist wherein the playing structure is freely rotatable about three axes.

13. The method of claim 12 wherein the mutatable characteristic is configurable by a game player.

14. A method of game play for a game apparatus comprising a playing structure viewable in three dimensional perspective, the playing structure comprising a plurality of substructures arranged into rows, columns, and diagonals, each substructure having a status of selected or non-selected, each substructure further having at least one other viewable mutatable characteristic; at lease one game play controller; at least one input device appropriate for selecting each of the substructures, the input device being operatively in communication with the game play controller; game play software executing within the game play controller; and at least one display device for displaying the playing structure as a three dimensional playing structure, the display device operatively in communication with the game play controller, the method comprising the steps of:

initializing all the mutatable characteristics of all the substructures to a predetermined state;

initializing all substructures to have a status of non-selected;

selecting a first game player from a set of at least one game players;

assigning selectively each other game player a sequential position for game play;

assigning a unique mutatable characteristic to each game player wherein said mutatable characteristics are substantially transparent; and allowing selection of at least one substructure by each game player sequentially, beginning with the first game player, until game play is completed, the sequential selection further comprising the steps of:

accepting game player input to select a non-selected substructure;

changing a status of the substructure from non-selected to selected;

changing by the game software of a mutatable characteristic of a selected substructure upon selection of that substructure to reflect the game players assigned mutatable characteristic;

rendering the playing structure by the game software on the display device according to that substructure's mutatable characteristic as modified by each mutatable of each other substructure at least partially obscured by that substructure when viewed in perspective;

wherein a first substructure indicates the unique mutatable characteristic of the game player whom selected it as modified by each unique mutatable characteristics of the same game player or any other game player who selected any of the other substructure that at least partially obscure said first substructure when viewed in such a perspective;

ending the game if selecting a non-selected substructure completes a row, column, or diagonal for the game player by each substructure in the row, column, or diagonal having that game player's mutatable characteristic;

ending the game if the game player selects the last non-selected substructure; and continuing the game play if selecting a non-selected substructure does not complete the row, column, or diagonal for the game player and other non-selected substructures exist wherein the playing structure is freely rotatable about three axes.

15. The method of claim 14, further comprising the steps of accepting directives from a game player.

16. The method of claim 15 further comprising the steps of:

accepting at least one directive from a game user to change perspective of the playing structure;

adjusting how the game playing structure is situated about its axes recording to the directive; and rendering the game playing structure on the display device according to a first substructure's mutatable characteristic as modified by each mutatable characteristic of each other substructure at least partially obscured by the first substructure when viewed in perspective.

17. The method of claim 15 where the directives comprise perspective directives, help directives, informational directives, and game play directives.

18. The method of claim 17 where perspective directives comprise rotational directives and zoom directives.

19. The method of claim 17 where help directives comprise requests for explanations of game play, requests to distinguish non-selected substructures, requests to distinguish a game player's selected substructures, and explanations of game configuration.

20. The method of claim 14, further comprising the steps of selecting a mode of game play.

21. The method of claim 20 where the mode of play comprises limiting play by elapsed time, limiting play by number of selected substructures per game player, requiring selection of non-selected substructures to including an affirmative act by a game player making the selection, and having the game play software assume a role as a game player.

22. The method of claim 21, where the affirmative act is correctly answering a question posed by the game software.

23. The method of claim 14, further comprising the steps of exhibiting end of game behavior upon ending of the game.

24. The method of claim 23 wherein the end of game behavior is selected from the group of behavior consisting of sound, visual presentation, and movement.

25. The method of claim 14 further consisting the steps of providing feedback to the game player during game play.

26. The method of claim 25 wherein the feedback is selected from the group of feedback consisting of sound, visual display, and movement.

27. The method of claim 26 wherein the sound is speech.

28. The method of claim 27 wherein the speech embodies a personality.

29. The method of claim 28 where the personality is configurable.

30. The method of claim 26 wherein the visual display is selected from the group of visual displays including text, graphics, colors, patterns, and animation.

* * * * *